US005772204A

United States Patent [19]

Phelps

[11] Patent Number: 5,772,204

[45] Date of Patent: Jun. 30, 1998

[54] TABLE TOP BOWLING GAME

[76] Inventor: Inga E. Phelps, 11232 Rainbow Woods Loop, Spring Hill, Fla. 34609

[21] Appl. No.: 829,362

[22] Filed: Apr. 2, 1997

[51] Int. Cl.[6] ..... A63D 3/00

[52] U.S. Cl. ..... 273/108.1; 273/108; 273/118 R; 273/DIG. 20; 473/595

[58] Field of Search ..... 273/108, 108.1, 273/118 R, DIG. 20; 473/594, 595

[56] References Cited

U.S. PATENT DOCUMENTS

| | | | |
|---|---|---|---|
| 693,821 | 2/1902 | De Ford | 473/594 X |
| 887,014 | 5/1908 | Parker . | |
| 1,050,835 | 1/1913 | Jensen . | |
| 1,483,590 | 2/1924 | Morang | 273/108 |
| 1,731,353 | 10/1929 | Schmitt et al. | 273/108 |
| 1,755,062 | 4/1930 | Hernes et al. | 273/108 |
| 2,006,230 | 6/1935 | Dobbins | 473/595 |
| 2,524,546 | 10/1950 | Sinclaire | 273/108 |
| 3,178,184 | 4/1965 | Glassman . | |
| 3,865,378 | 2/1975 | McPhail et al. . | |
| 3,934,880 | 1/1976 | Laszlo | 273/108 |
| 4,181,302 | 1/1980 | Sexton et al. | 273/DIG. 20 X |
| 4,641,839 | 2/1987 | Turner | 473/125 X |
| 4,991,844 | 2/1991 | Derry | 273/118 R X |
| 5,358,448 | 10/1994 | Stephens | 273/DIG. 20 X |

*Primary Examiner*—Raleigh W. Chiu
*Attorney, Agent, or Firm*—James E. Larson; Larson & Larson, P.A.

[57] ABSTRACT

A bowling game is made to be played on any flat, smooth table top. Nine bowling pins are arranged in a pattern on the table top in a 3×3 array. A ball is provided having one hemisphere made of lead glued to another hemisphere made of hard wood. The ball is spun toward the array of pins. Scoring is based upon knocking down a particular prescribed pattern of pins and being awarded the number of points corresponding to that pattern and varying between 5 points and 40 points. The first player to earn 100 points wins the game.

12 Claims, 3 Drawing Sheets

TABLE TOP BOWLING GAME

BACKGROUND OF THE INVENTION

The present invention relates to a table top bowling game. In the prior art, bowling games are known. Such games include balls of various sizes and structures and pins arranged in various configurations. However, Applicant is unaware of any such bowling game including all of the features and aspects of the present invention.

The following prior art is known to Applicant:

U.S. Pat. No. 887,014 to Parker

U.S. Pat. No. 1,050,835 to Jensen

U.S. Pat. No. 2,524,546 to Sinclaire

U.S. Pat. No. 3,178,184 to Glassman

U.S. Pat. No. 3,865,378 to McPhail et al.

U.S. Pat. No. 4,181,302 to Sexton et al.

U.S. Pat. No. 4,991,844 to Derry.

Parker describes a bowling game played within a frame and wherein bowling pins are set up interposed among fixed stakes. A spinning top is employed to knock down the pins to obtain a score. The present invention differs from the teachings of Parker as contemplating a game devoid of fixed stakes or a frame, employing a spherical ball of unbalanced weight and wherein the pins are set up in a different configuration than that of Parker.

Jensen teaches a shake ball with a weight embedded therein and including a flat surface. The present invention contemplates use of a ball having a weighted hemisphere and no flat surfaces.

Sinclaire teaches an unevenly weighted sphere, however, Sinclaire fails to teach an unevenly weighted hemisphere.

Glassman describes a bowling game wherein play is conducted on an inclined board and a top is spun across the board to strike pins. The present invention differs from the teachings of Glassman as contemplating play on a flat surface and the use of a spherical unevenly weighted ball.

McPhail et al. describe a curling bowl that is non-spherical and wherein balls are the targets. The present invention differs from the teachings of McPhail et al. as contemplating a game played on a flat surface and wherein a spherical ball of unevenly distributed weight is spun toward an array of pins.

Sexton et al. describe a ball having a variable weight distribution for use in a game. However, Sexton et al. do not describe a ball having uneven weight distribution as taught by Applicant.

Derry teaches an apparatus for playing a ball game on a flat surface wherein a ball of uneven weight distribution is employed. However, Derry fails to teach the use of pins in his game.

SUMMARY OF THE INVENTION

The present invention relates to a table top bowling game. The present invention includes the following interrelated objects, aspects and features:

(1) In a first aspect, the inventive game is designed to be played on any open, flat surface such as a table top, for example, a card table, or, if desired, a flat, smooth floor surface.

(2) The inventive game includes a ball that is made of two hemispheres attached together. In the preferred embodiment, one hemisphere is made of hard wood while the other hemisphere is made of lead. In this way, the weight distribution of the ball is quite uneven causing it to travel in an arcuate path when spun.

(3) The inventive game also includes the use of pins that resemble traditional bowling pins and that are arranged in an array on the flat game surface. In the preferred embodiment, the array consists of three rows and three columns, a 3×3 array.

(4) In playing the game, the pins are set up in the 3×3 array in a desired region on the playing surface. The ball is grasped between the fingers and is spun toward the array. The object of the game is to knock down a pattern of pins corresponding to a multiplicity of listed patterns, with each listed pattern being assigned a number of points. In the preferred embodiment, there are seven listed patterns with points to be awarded varying from 5 points to 40 points. The first player to achieve 100 points wins the game.

Accordingly, it is a first object of the present invention to provide a table top bowling game.

It is a further object of the present invention to provide such a game wherein the ball that is employed is made of two hemispheres attached together, one of hard wood, the other of lead.

It is a still further object of the present invention to provide such a game to be played on any flat surface and employing a multiplicity of pins arranged in an array.

It is a still further object of the present invention to provide such a game wherein the object thereof is to knock down a pattern of pins corresponding to a listed pattern being assigned a number of points.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
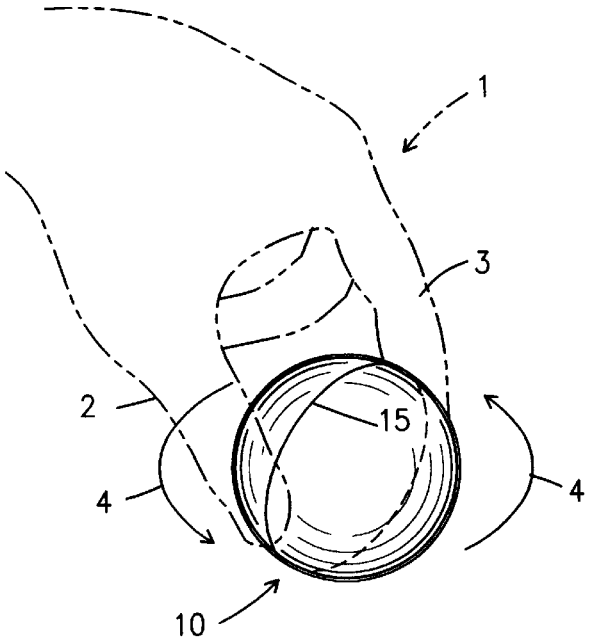
FIG. 1 shows a game ball being grasped between the thumb and forefinger of a player.
Figure 2:
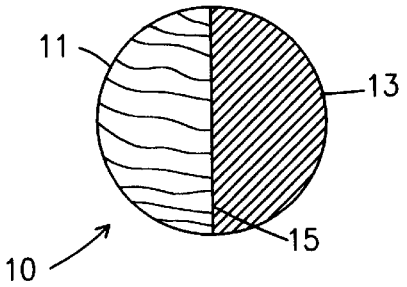
FIG. 2 shows a cross-sectional view through the game ball.

With reference to FIGS. 1 and 2, a game ball is generally designated by the reference numeral 10 and is seen to include a first hemisphere 11 made of hard wood and a second hemisphere 13 made of lead. These hemispheres 11, 13 are affixed together at the interface line 15 by any suitable means such as, for example, adhesive.

Figure 3:
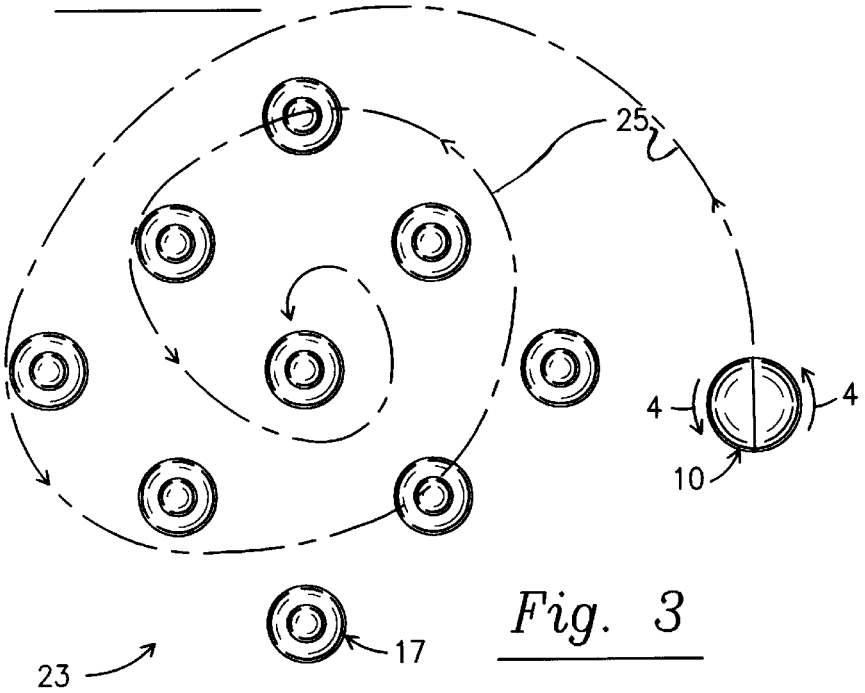
FIG. 3 shows a side view of a typical pin used in playing the inventive game.

FIG. 3 shows a side view of a pin 17 having an enlarged base 19 and a top portion 21, which configuration causes the pin to have a weight distribution toward the enlarged base 19.

Figure 4:
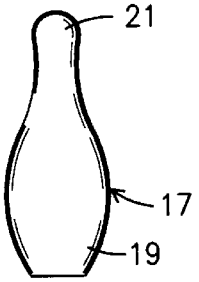
FIG. 4 shows a top view of an array of pins arranged in accordance with the teachings of the present invention and with a game ball being spun toward the array.
Figure 5:
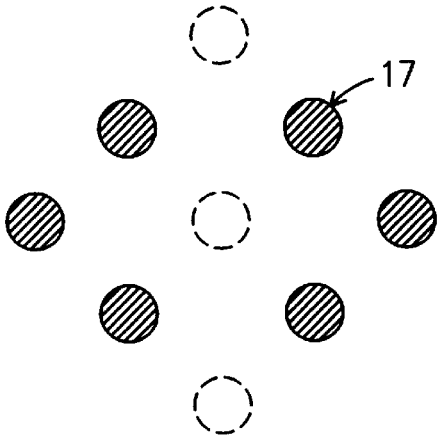
FIGS. 5–11 show respective patterns of knocked-down pins that players attempt to achieve when playing the game.
Figure 6:
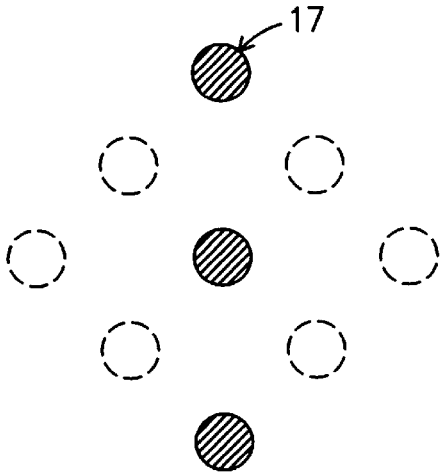
Figure 7:
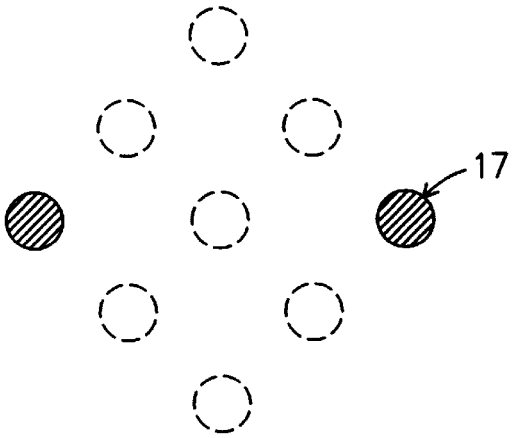
Figure 8:
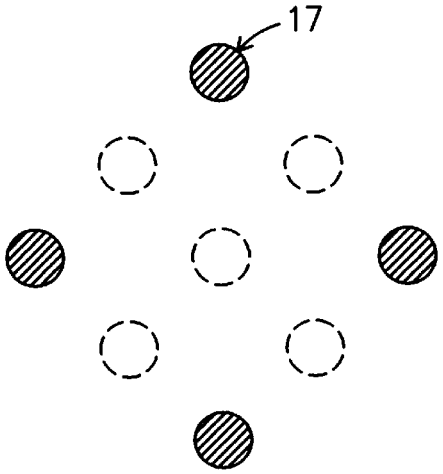
Figure 9:
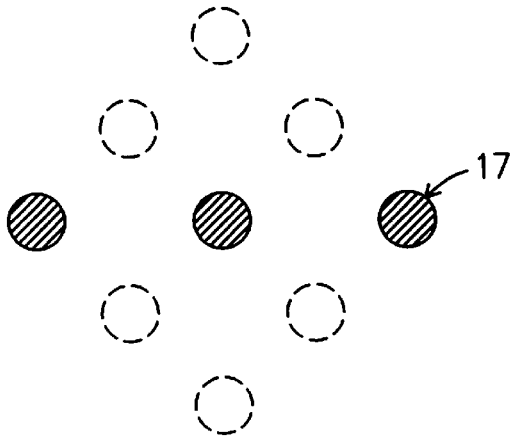
Figure 10:
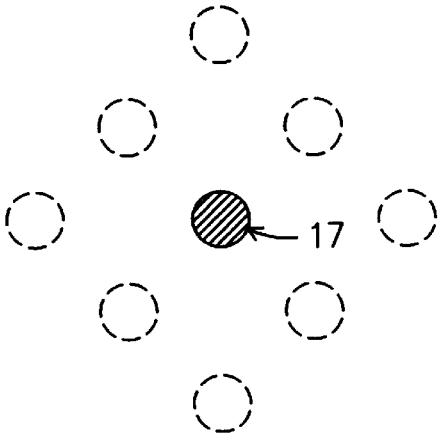
Figure 11:
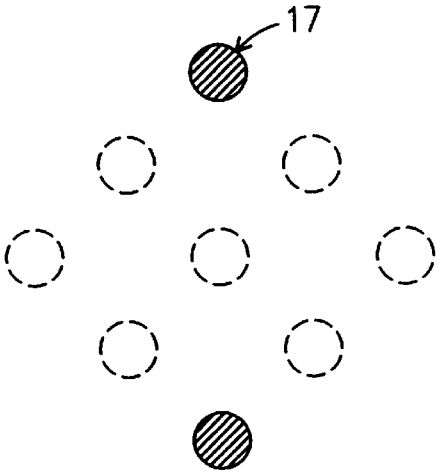

FIG. 4 shows an array 23 of nine pins, which array may be described as 3×3 with the nine pins being equally spaced from one another to provide a square configuration.

With reference to FIG. 1, the hand of the user is generally designated by the reference numeral 1 and is seen to include a thumb 2 and a forefinger 3. As seen in FIG. 1, the preferred mode of gripping the ball 10 is with the thumb 2 and the forefinger 3 on opposite sides of the interface 15. In this orientation, the thumb 2 and forefinger 3 are spun in the direction of the arrow 4 to cause the ball 10 to spin like a top. The same reference numeral 4 is employed in FIG. 4 to describe the arrows depicting the direction of rotation of the ball 10. When the ball 10 is so spun, it travels in an arcuate path described by the discontinuous line 25 in FIG. 4. As seen in FIG. 4, the spacing of the pins 17 from one another is greater than the diameter of the ball 10. Thus, when the ball 10 is spun toward the array 23 of pins 17, the ball may spin between adjacent pins on its path toward striking pins. FIGS. 5–11 depict various configurations of pins having been knocked down through the playing of the game. In these figures, the pins shown in phantom have been knocked down and the other pins comprise a pattern of pins that remain standing after the other pins have been knocked down. The following table provides the amount of points awarded concerning each pattern of pins that has been knocked down:

TABLE

| Figures | Point Totals |
|---|---|
| 5 | 5 |
| 6 | 10 |
| 7 | 15 |
| 8 | 20 |
| 9 | 25 |
| 10 | 30 |
| 11 | 40 |

In the preferred mode of playing the game, each player has two turns to achieve one of the patterns of knocked-down pins depicted in FIGS. 5–11. If, after two turns have been taken, the player has failed to achieve one of the patterns depicted in FIGS. 5–11, no points are awarded. For example, if all of the pins are knocked down after one or two turns, no points are awarded.

In the preferred embodiment, the first player to obtain 100 points wins the game.

In the preferred embodiment, the pins 17 may be made of any suitable material such as wood, metal, plastic, etc. As explained above, the ball 10 is preferably made of a hemisphere of lead affixed to a hemisphere of hard wood, preferably through some desirable adhesive. In the preferred embodiment, each pin 17 is approximately 2½ inches tall with the ball 10 being 1 inch in diameter. The array shown in FIG. 4 is preferably set up with the pins approximately 2 inches apart in the lateral directions (not diagonally).

As such, an invention has been described in terms of a preferred embodiment thereof which fulfills each and every one of the objects of the invention as set forth hereinabove and provides a new and useful table top bowling game of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A bowling game, comprising:

a) a spherical ball including two hemispheres attached together, one hemisphere made of a relatively light-weight material, another hemisphere made of a relatively heavy material;

b) a plurality of pins arranged in an array on a flat surface and spaced from one another by a distance greater than a diameter of said ball;

c) said ball being spun toward said array in an arcuate path to knock down some of said pins leaving a pattern of pins standing, which pattern corresponds to a particular point award;

d) said game being won by a player achieving a preset total number of points achieved during a series of turns.

2. The game of claim 1, wherein said one hemisphere is made of wood.

3. The game of claim 2, wherein said another hemisphere is made of lead.

4. The game of claim 1, wherein said array comprises 9 pins arranged 3×3.

5. The game of claim 4, wherein said pattern of pins standing includes 1 pin.

6. The game of claim 4, wherein said pattern of pins standing includes 2 pins.

7. The game of claim 4, wherein said pattern of pins standing includes 3 pins.

8. The game of claim 4, wherein said pattern of pins standing includes 4 pins.

9. The game of claim 4, wherein said pattern of pins standing includes 6 pins.

10. The game of claim 1, wherein said spherical ball is 1 inch in diameter.

11. The game of claim 1, wherein said distance is 2 inches.

12. The game of claim 1, wherein said flat surface comprises a table top.

* * * * *